US005564808A

United States Patent [19]

Gipson, Jr. et al.

[11] Patent Number: 5,564,808

[45] Date of Patent: Oct. 15, 1996

[54] FLUSH APPEARANCE TRIM WITH ALLOWANCE FOR DOOR ADJUSTABILITY

[75] Inventors: Billy P. Gipson, Jr., Marshall County; Thomas C. Hill, Nashville, both of Tenn.

[73] Assignee: Whirlpool Corporation, Benton Harbor, Mich.

[21] Appl. No.: 517,806

[22] Filed: Aug. 22, 1995

Related U.S. Application Data

[63] Continuation of Ser. No. 122,982, Sep. 20, 1993, abandoned.

[51] Int. Cl.[6] ..... A47B 96/00; E05D 7/00; E06B 3/00

[52] U.S. Cl. ..... 312/405; 312/296; 49/501

[58] Field of Search ..... 312/400–406, 312/198, 199, 236; 49/500, 501, 386, 398–402; 52/455, 717.1, 818, 820, 821, 656.4, 656.5, 224.53–224.56, 506.9–511; 62/256, 440–449

[56] References Cited

U.S. PATENT DOCUMENTS

| | | | |
|---|---|---|---|
| 3,006,708 | 10/1961 | Saunders et al. | 49/401 X |
| 4,223,482 | 9/1980 | Barroero et al. | 312/321.5 X |
| 4,843,783 | 7/1989 | Taravella | 52/717.01 X |
| 4,937,978 | 7/1990 | Johansson et al. | 49/399 |
| 4,948,206 | 8/1990 | Fitzpatrick | 49/402 X |
| 5,048,233 | 9/1991 | Gidseg et al. | 49/501 |
| 5,113,628 | 5/1992 | Richardson et al. | 312/405 X |

*Primary Examiner*—Peter M. Cuomo
*Assistant Examiner*—Robert J. Sandy
*Attorney, Agent, or Firm*—Thomas J. Roth; Joel M. van Winkle

[57] ABSTRACT

An appliance is provided with trim about at least a portion of the periphery of its door as well as a cabinet forming a compartment which the door encloses. The trim on the door provides a flush appearance for the appliance while providing adjustability of the door with respect to the cabinet to satisfy gasket spacing requirements therebetween. The door, therefore, may be adjusted without affecting the flush appearance of the appliance created by the trim of the door.

17 Claims, 1 Drawing Sheet

FLUSH APPEARANCE TRIM WITH ALLOWANCE FOR DOOR ADJUSTABILITY

This is a continuation of application Ser. No. 08/122,982, filed Sep. 20, 1993, now abandoned.

BACKGROUND OF THE INVENTION

This invention relates generally to a domestic appliance and more particularly to a refrigeration appliance having a cabinet and a door each including respective trim wherein the door is adjustable in such a manner so as not to affect the flush relationship of the exterior trim.

Of course, it is commonly and generally known to provide trim kits for decorative application to an appliance, such as a refrigerator. Conventional trim kits include a first trim strip attached to a door surface which protrudes forwardly therefrom for attachment of a decorative trim panel.

Further, it is known to provide a second trim strip to an edge of the cabinet which substantially matches the first trim strip applied to the door. The second trim strip is attached to the cabinet edge and protrudes forwardly therefrom so as to be flush with the first trim strip on the door with respect to a front plane of the appliance cabinet.

Also, it is known to provide for adjustment of the position of the door in order to align the door seal or gasket between the door and the cabinet. However, the adjustment typically results in the trim strips on the door and the cabinet being misaligned with respect to each other.

To resolve these problems, refrigeration appliances have been designed to provide for adjustment in the doors resulting in a desired flush appearance. In the alternative, refrigeration appliances have been designed to provide for a proper front-to-back gasket spacing between the cabinet and the door. However, an appliance having a decorative trim that resolves both of these problems has not been developed.

Door trim is typically designed to produce a "picture-frame" appearance when a door of an appliance is closed. Such a design is typically achieved with two side trim pieces and one top trim piece affixed to the appliance cabinet to form an exterior portion of the frame. The exterior portion surrounds an interior portion formed by trim pieces which are attached to the doors. A gap of approximately one-quarter of an inch between the exterior portion and the interior portion provides the desired picture-frame appearance.

Often, however, it is difficult to secure the door on the product, such as a refrigerator, to maintain the desired gap consistently around the periphery of the product. Furthermore, the door frequently requires front-to-back adjustment to satisfy gasket spacing requirements between the door and the cabinet which often destroys the desired flush, picture-frame appearance.

A need, therefore, exists for providing an improved trim kit assembly resulting in a picture-frame appearance and further eliminates the requirement of adjusting the door to provide a flush appearance between the door trim and the cabinet trim, yet provides for door adjustability for satisfying gasket spacing requirements.

SUMMARY OF THE INVENTION

The present invention relates to domestic appliances and more particularly to a refrigeration appliance which eliminates the necessity of adjusting the door to provide a flush appearance between the trim of the cabinet and the trim of the door.

To this end, a refrigeration appliance is provided having a cabinet enclosed by a door wherein the cabinet includes a pair of side walls, a top wall and a bottom wall defining an access opening. The door has a first vertical edge and a second vertical edge parallel to the first vertical edge, the door enclosing the opening. The refrigeration appliance comprises a first trimming piece mounted at a front edge of the pair of side walls and projecting in a forward direction toward the door and a second trimming piece mounted on at least the first vertical edge and the second vertical edge of the door. The second trimming piece overlies the first trimming piece to the front with the first and second trimming pieces being horizontally flush at the sides of the cabinet. This enables a front-to-back adjustment of the door without affecting the side alignment of the trimming pieces.

In an embodiment, the refrigeration appliance comprises a gasket between the door and the cabinet.

In an embodiment, the second trimming piece extends around the periphery of the door on its front face.

The present invention further provides a trim kit assembly for application to an appliance having at least one compartment defining an interior wherein the compartment is enclosed by an adjustable door movable between an open position and a closed position. The trim kit assembly comprises a first trimming piece extending perpendicularly to the interior of the compartment on side walls of the compartment and a second trimming piece connected to at least a portion of the periphery of the door and overlying the front of the first trimming piece when the door is in the closed position wherein front-to-back adjustment of the door does not affect side alignment between the first trimming piece and the second trimming piece.

In an embodiment, at least the second trimming piece includes a longitudinal groove.

In an embodiment, the first trimming piece and the second trimming piece are each individually extruded as a single part.

The present invention further provides a method for providing a flush appearance adjustable door connected to a compartment defining an opening wherein the door may be selectively opened and closed. The method comprises providing a first trim piece for at least partially securing about peripheral side walls of the compartment wherein the first trim piece extends perpendicularly to a plane defining the opening toward the door and providing a second trim piece for at least partially securing about a periphery of the door to extend over a front of the first trim piece when the door is closed wherein the door is front-to-back adjustable without affecting the horizontal alignment relationship between the first trim piece and the second trim piece.

It is, therefore, an advantage of the present invention to provide a domestic appliance, such as a refrigeration device, having a flush, picture-frame appearance when a door of the appliance is closed.

A further advantage of the present invention is to provide an appliance having an adjustable door which does not affect the flush appearance of the trim.

A still further advantage of the present invention is to provide an appliance having an adjustable door for satisfying gasket spacing requirements.

Moreover, an advantage of the present invention is to provide a trim for an appliance which may be extruded in a single part.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
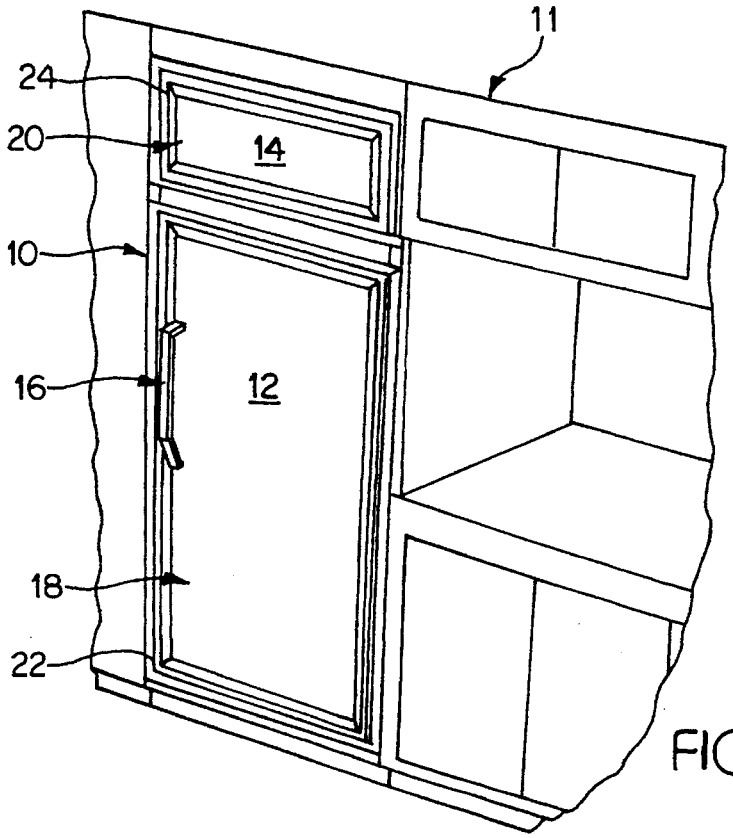
FIG. 1 is a perspective view of an appliance having the flush appearance trim of the present invention.

In FIG. 1, there is illustrated an appliance at 10 comprising a fresh food compartment, a frozen food compartment or, alternatively, a combination of compartments. The appliance 10 is generally shown within an opening of a cabinet-type structure 11 such that the appliance 10 has a "built-in" look with respect to the cabinet-type structure 11.

The particular embodiment illustrated in FIG. 1 includes a first compartment 12 which may be, for example, a fresh food compartment, a freezer compartment or a combination-type compartment. A second compartment 14 is also illustrated which may, like the first compartment 12, be a fresh food compartment, a freezer compartment or a combination of compartments. Typically, however, the first compartment 12 is a fresh food compartment, and the second compartment 14 is a frozen compartment.

The first compartment 12 includes a handle 16 for selectively opening and closing the first compartment 12 for access to an interior of the compartment 12 contained behind a door 18 enclosing the compartment 12. The second compartment 14 may similarly include a handle for access to an interior of the compartment behind a door 20 of the second compartment 14 or may provide other conventional means for access to the interior of the compartment as is well known in the art.

Each of the doors 18, 20 further includes trim generally about the entire periphery of the doors 18, 20. The door 18 includes trim piece 22, and the door 20 includes trim piece 24. As illustrated in FIG. 1, each of the trim pieces 22, 24 extend around the entire periphery of their respective doors 18, 20. However, the trim pieces 22, 24 may, alternatively, be secured about any lesser portion of the periphery of the doors 18, 20.

Figure 2:
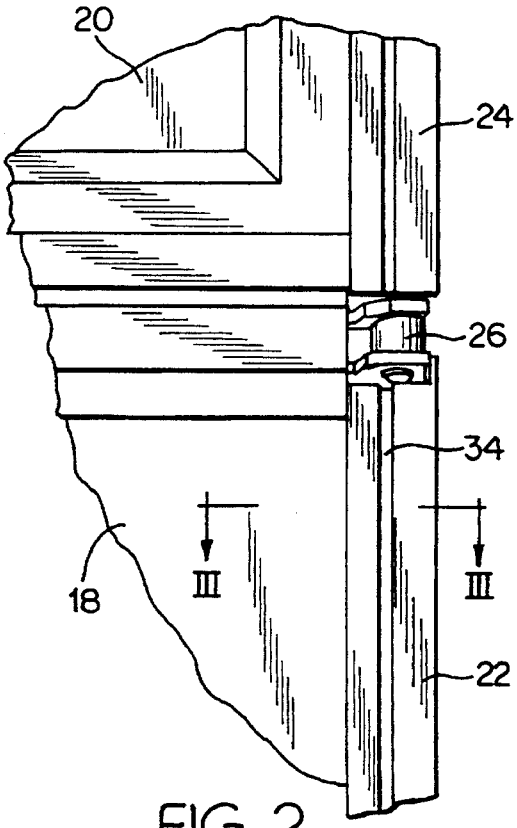
FIG. 2 is a fragmentary front elevational view of the trim pieces of the present invention secured to a door of an appliance.

Referring now to FIG. 2, a hinge 26 about which the doors 18, 20 open is generally shown between the vertical portions of the trim pieces 22, 24. The first compartment 12 and the second compartment 14, respectively, meet at the hinge 26 such that the hinge 26 may be used to assist in opening and closing the doors 18, 20. Of course, other arrangements may be implemented for providing access to the compartments 12, 14, such as sliding doors and drawer-type structures.

Figure 3:
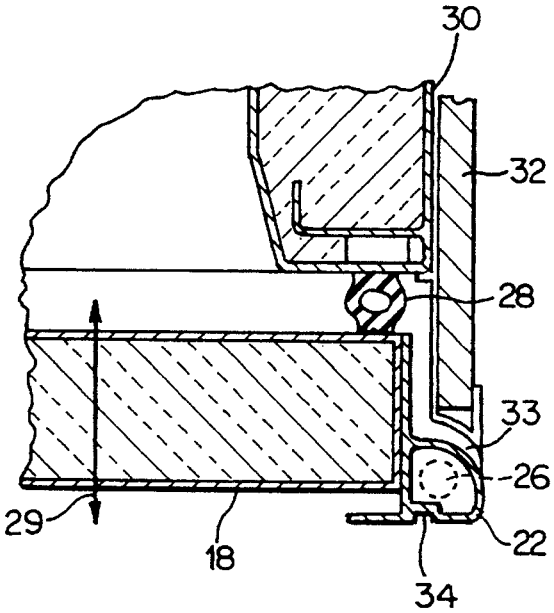
FIG. 3 is a fragmentary sectional view taken generally along lines III—III of FIG. 2.

As indicated by arrows 29 in FIG. 3, the doors 18, 20 are front-to-back adjustable to provide for proper spacing of a gasket 28. The gasket 28 is located intermediate an appliance cabinet wall 30 and the door 18. Secured to the cabinet wall 30 is a trim piece 32 providing a decorative look to the side of the appliance cabinet. The trim piece 32 extends perpendicularly to the opening to the interior of the appliance cabinet towards the door 18 to a point substantially adjacent to the trim piece 22. The trim piece 32 is, therefore, substantially parallel to the cabinet wall 30 and projects to nearly intersect with the trim piece 22 at the hinge 26. A spacing or gap 33 between the trim piece 32 and the trim pieces 22, 24 allows the doors 18, 20 to open and close without interference therebetween.

The trim piece 22 forms a partial front wall for the appliance 10 providing a decorative and flush appearance from a front view. The front wall of the trim piece 22 may include a groove, such as at 34, or other decorative finish to provide the picture frame appearance. The trim piece 22 including the groove 34 may be extruded in a single part. The consistent flush appearance of the trim pieces 22, 24 is maintained about the periphery of the doors 18, 20 of the appliance 10.

In addition, the door 18 or the door 20 may be adjusted front-to-back as required for providing proper spacing of the gasket 28 between the appliance cabinet wall 30 and the doors 18, 20. As a result, the doors 18, 20 may be individually adjusted as required toward or away from the appliance cabinet wall 30 without affecting the flush appearance created by the trim pieces 22, 24.

Each of the trim pieces 22, 24 may be formed with the continuous longitudinal groove 34. The trim pieces 22, 24 may further be attached by an adhesive or otherwise fastened in a known manner to the doors 18, 20, respectively. Similarly, the trim piece 32 may be secured to the appliance cabinet wall 30 by an adhesive or other known fastener.

The resultant trim pieces when attached to the doors 18, 20 provide a continuous picture-frame appearance for the appliance 10 when the doors 18, 20 are in their closed positions. Furthermore, the doors 18, 20 may be adjusted to provide for the required spacing of the gasket 28 of the appliance 10 without affecting the picture-frame appearance provided by the trim pieces 22, 24.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonable and properly come within the scope of our contribution to the art.

The embodiments of the invention in which an exclusive property or privilege is claimed are defined as follows:

1. An appliance having a cabinet enclosed by a door wherein the cabinet includes at least a side wall defining an access opening and the door includes at least a vertical edge wherein the door encloses the opening comprising:

a first trimming piece mounted at a front edge of said side wall of the cabinet and projecting in a forward direction toward the door; and a second trimming piece having a front wall, said second trimming piece mounted on said vertical edge of the door wherein the second trimming piece is mounted in front of and overlies the first trimming piece at a front of the cabinet, said first trimming piece positioned entirely behind said front wall and enables front-to-back adjustment of the door without affecting side alignment of the trimming pieces.

2. The appliance of claim 1 further comprising a gasket between the door and the cabinet.

3. The appliance of claim 1 wherein the first trimming piece is integrally formed.

4. The appliance of claim 1 wherein the second trimming piece is integrally formed.

5. The appliance of claim 1 wherein the second trimming piece includes a longitudinal grooved section.

6. The appliance of claim 1 wherein the cabinet and the door encloses a refrigeration compartment.

7. The appliance of claim 1 wherein the cabinet and the door encloses a freezer compartment.

8. A trim kit assembly for application to an appliance having at least one compartment defining an interior wherein the compartment is enclosed by an adjustable door, comprising:

a first trimming piece extending perpendicularly to an opening defining a plane to the interior of the compartment on a peripheral sidewall of the compartment;

a second trimming piece having a front wall, said second trimming piece for connecting to at least a portion of the periphery of the door and mounting in front of and overlying the first trimming piece, said first trimming piece being positioned entirely behind said front wall, resulting in side alignment of the first trimming piece and the second trimming piece wherein adjustment of the door does not affect the side alignment between the first trimming piece and the second trimming piece.

9. The trim kit assembly of claim 8 wherein the second trimming piece includes a longitudinal groove.

10. The trim kit assembly of claim 8 wherein the first trimming piece and the second trimming piece are each individually extruded as a single part.

11. The trim kit assembly of claim 8 wherein at least a portion of the second trimming piece is formed along a hinge about which the door selectively pivots for opening.

12. A method for providing a flush appearance adjustable door connected to a cabinet defining a compartment comprising:

providing a first trim piece for at least partially securing about a peripheral sidewall of the cabinet wherein the first trim piece extends perpendicularly to a plane defining an opening to the compartment; and providing a second trim piece having a front wall for at least partially securing about a periphery of the door, said second trim piece to extend in front of and over the first trim piece resulting in a side alignment of the first trim piece and the second trim piece, said first trim piece being positioned entirely behind said front wall, wherein the door is adjustable without affecting the side alignment between the first trim piece and the second trim piece.

13. The method of claim 12 wherein the first trim piece and the second trim piece are each integrally formed.

14. The method of claim 12 further comprising the step of: providing a longitudinal groove in at least the second trim piece.

15. The method of claim 12 wherein the compartment is a refrigeration compartment.

16. The method of claim 12 wherein the compartment is a freezer compartment.

17. An appliance having a cabinet with a wall, the wall having a peripheral edge defining an access opening, a door with a peripheral edge being mounted to the cabinet for enclosing the access opening, and a plane of the door and a plane of the access opening being generally parallel when the door encloses the access opening, the appliance comprising:

a first trimming piece with an outer edge, the first trimming piece being mounted to cabinet and extending beyond the peripheral edge of the wall in a direction generally orthogonal to the plane of the door; and a second trimming piece with an outer edge, the second trimming piece being mounted to the door and extending away from the door beyond the peripheral edge of the door in a direction generally parallel to the plane of the door and in overlying relationship relative to the first trimming piece so that the outer edge of the first trimming piece and the outer edge of the second trimming piece are substantially flush and lie in a plane generally orthogonal to the plane of the door to permit adjustment of the door with respect to the access opening in a direction orthogonal to the plane of the access opening while maintaining the flush alignment of the outer edges of the first and second trimming pieces.

* * * * *